United States Patent [19]

Burrell

[11] 4,173,835

[45] Nov. 13, 1979

[54] SNOW REMOVAL TOOL

[76] Inventor: Dean W. Burrell, 35 Jefferson St., Ellicottville, N.Y. 14731

[21] Appl. No.: 847,409

[22] Filed: Oct. 31, 1977

[51] Int. Cl.[2] ..... E01H 5/02

[52] U.S. Cl. ..... 37/53; 56/400.01; 56/400.04; 56/400.07; 294/59

[58] Field of Search ..... 37/53; 172/371, 375, 172/378–382; 56/400.01, 400.20, 400.04, 400.05, 400.06, 400.07, 400.16, 400.21, 400.03, 400.08, 400.09, 400.10, 400.11, 400.17; 294/59; 403/4; 76/111

[56] References Cited

U.S. PATENT DOCUMENTS

| | | | |
|---|---|---|---|
| 1,107,035 | 8/1914 | Cloue et al. | 56/400.1 |
| 1,127,233 | 2/1915 | Hadford | 172/375 |
| 2,396,089 | 3/1946 | Cross | 56/400.21 |
| 2,497,192 | 2/1950 | Thayer, Jr. | 56/400.21 X |
| 2,597,767 | 5/1952 | Williams | 56/400.04 X |
| 2,780,976 | 2/1957 | Koering | 56/400.04 X |
| 2,794,312 | 6/1957 | Finkes | 56/400.21 X |
| 2,797,544 | 7/1957 | Fite | 56/400.1 |
| 2,908,131 | 10/1959 | Ross | 56/400.04 |
| 3,818,688 | 6/1974 | Drummond | 56/400.01 |

FOREIGN PATENT DOCUMENTS

| | | | |
|---|---|---|---|
| 108118 | 7/1939 | Australia | 56/400.17 |
| 1066608 | 6/1954 | France | 56/400.01 |
| 50034 | 11/1909 | Switzerland | 56/400.07 |
| 131248 | 8/1919 | United Kingdom | 403/4 |

*Primary Examiner*—E. H. Eickholt

*Attorney, Agent, or Firm*—Bean, Kauffman & Bean

[57] ABSTRACT

A hand tool useful for shifting snow or other flake or granular material is disclosed. The device resembles a conventional metal rake with a blade attached to the ends of the tines. Alternating tines or strips are deflected in opposite directions and are fastened to the blade so as to form a construction which lends stiffness to the tool.

6 Claims, 5 Drawing Figures

10
10a
12
14
16
16a
18
20
20a
22
22a
24
26
28
30
32
34
36
3
4

SNOW REMOVAL TOOL

BACKGROUND OF THE INVENTION

1. Field of the Invention

The present invention relates to a hand tool useful for shifting flake or other granular material. More specifically, the present invention relates to a tool which may be used in a sweeping motion in order to move limited quantities of snow.

2. The Prior Art

Conventional tools such as shovels and brooms are the most frequently used hand tools for the removal of accumulations of snow on driveways and sidewalks. Each of these hand tools have their drawbacks however. In the case of a shovel adapted to the removal of snow, the use of a shovel creates a significant danger to the health of the person removing the snow. It is well known that a person shoveling snow can easily overexert himself. In some cases such overexertion leads to a fatal heart attack. Additionally removal of heavy snow often leads to serious back problems. Accordingly, the aged and the infirm are effectively precluded from shoveling snow especially if the snow fall is a heavy one.

In the case of a broom, which is more frequently used by the aged and the infirm, the broom itself has deficiencies when used to remove snow. A broom, when used to sweep aside snow, will frequently deflect due to the lack of rigidity or stiffness of the bristles of the broom so that the snow, rather than being removed, is compacted in a manner which makes it very difficult to remove by further exertions with the broom. In such a case, the objective of snow removal is frustrated and the compacted snow has to be left on the sidewalk unless another tool, such as an edging tool or ice scraper, is available for loosening the compacted snow from the underlying surface. It can be seen therefore, that the broom is inadequate in most cases for snow removal due to the lack of a cutting or scraping edge and due to its flexibility.

BRIEF SUMMARY OF THE INVENTION

The foregoing deficiencies and others are alleviated by the present invention which relates to a hand tool, which is designed to aid in the manual shifting of flake or other granular material such as snow or grain. The tool of the invention is much like a conventional leaf rake, with a handle, a laterally disposed plate and tines or strips projecting longitudinally in the direction of the handle from the lateral plate at spaced intervals; however, here the ends of the strips are fastened to a laterally disposed blade which not only combines the assemblage into a semi-rigid working end but also provides cutting and scraping edges which may be useful in dislodging slightly packed snow. Each of the strips, as in a conventional rake, has a lateral width which provides partial obstruction to the flow of the snow from one side of the tool to the other when the tool is moved with a sweeping motion in the direction in which the flat sides of the strips face. With this arrangement, sufficient contact with either loose or compacted snow exists so as to permit the efficient movement of the snow by movement of the tool. By the same token, however, the tool is unsuitable for the heavy type of lifting and throwing work that brings about the commonly occuring heart attacks and backaches that result from the use of a conventional snow shovel. The semi-rigid construction, as well as the cutting and scraping edges of the blade portion of the tool, make it possible to attack and dislodge semi-compacted snow and ice. By the same token, however, the construction of the tool is not such as to permit the expenditure of excessive amounts of energy. Accordingly, the tool of the present invention is suitable for use by the aged, the infirm, and woven as well as by children and indeed strong, healthy adult males.

BRIEF DESCRIPTION OF THE DRAWINGS

The present invention may be better understood an its numerous objects and advantages will become apparent to those skilled in the art by reference to the accompanying drawings wherein like reference numerals refer to like elements in the several figures and in which.

DESCRIPTION OF THE PREFERRED EMBODIMENT

Figures 1, 2, 3, 4, 5:
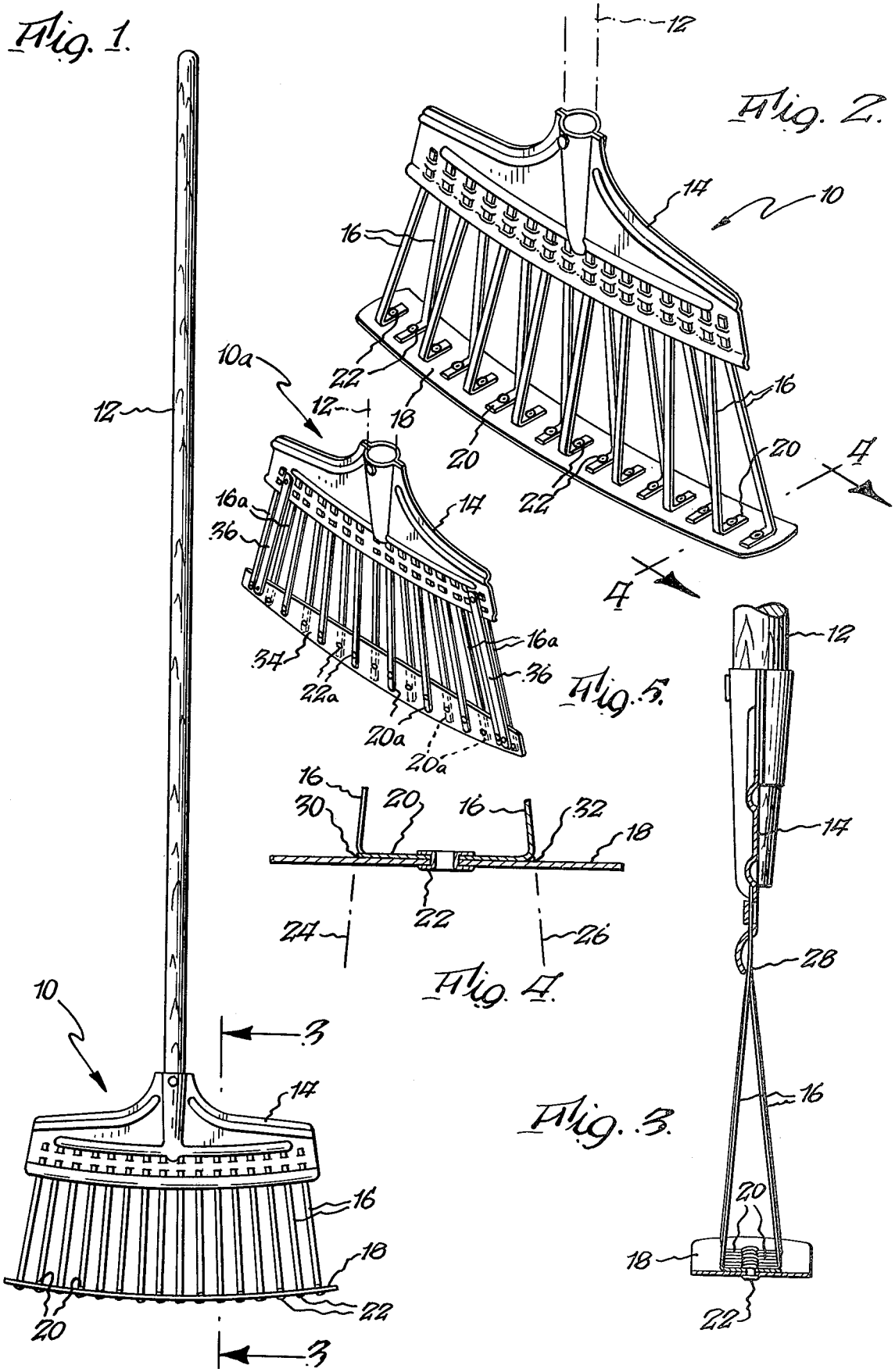
FIG. 1 is a front elevation of the tool of the present invention.
FIG. 2 is a perspective view of the working end of the tool.
FIG. 3 is a side cross-section elevation of the tool taken along view lines 3—3 of FIG. 1.
FIG. 4 is a side cross-sectional elevation of a portion of the working end of the tool taken along the view lines 4—4 of FIG. 2.
FIG. 5 is a perspective view of the working end of a second embodiment of the tool.

While the invention is susceptible of various modifications and alternative constructions, there is shown in the drawings and there will hereinafter be described, in detail, a description of the preferred embodiment of the present invention. It is to be understood, however, that the specific description and drawings are not intended to limit the invention to the specific form disclosed. On the contrary, it is intended that the scope of this patent include all modifications and alternative constructions thereof falling within the spirit and scope of the invention as expressed in the appended claims.

One embodiment of the present invention is illustrated in FIGS. 1 and 2. The tool generally referred to at 10 in FIG. 1 consists of a longitudinally extending handle 12, a laterally extending base member 14 or base plate fixed to one end of the handle 12, a plurality of longitudinally extending support members or strips 16 having first and second ends fastened at laterally spaced intervals to plate 14 at their first ends and longitudinally extending generally parallel to the longitudinally extending handle, and a laterally extending connecting member or blade 18 attached to each of the plurality of support members or strips 16 at their second ends. Each of the strips 16 have flat sides oriented to face in a direction generally normal to both the handle 12 and the plate 14 so that the flat sides of the strips provide side-to-side resistance to flow of the material to be removed when the tool 10 is swept in the direction in which the flat sides face.

As can be seen from FIGS. 1–4, blade 18 comprises a rectangular plate oriented to face in the direction of the handle 12. Plate 18 is curved so as to form a cylindrical section whose convex surface faces away from the handle. With this arrangement, the edges of blade 18 are available for attacking, chipping and scraping and otherwise loosening slightly compacted snow and ice.

The overall appearance of the tool is strikingly similar to the convenional leaf rake. However, the ends of all of the tines in a leaf rake are bent in the same direction at right angles to the tines to form L-shaped hooks. As can be seen from the drawings, every other strip 16 of the tool 10 is bent at its end 20 in an opposite direction and then fastened by means of rivets 22 to blade 18. A first multiplicity of the strips lie in a first plane which is formed at an angle to the central plane of symmetry of the tool 10 and a second multiplicity of the strips lie in a second plane which forms an angle in the other direction with the central plane of symmetry of the tool 10. Accordingly, the first and second planes intersect in a line indicated in FIG. 3 at 28. The first and second planes respectively intersect to blade 18 along intersection lines 30 and 32. With this construction, a triangular arrangement is achieved with the first multiplicity of strips lying in a first side of the triangle, the second multiplicity of strips lying in the second side of the triangle and the plate 18 lying in the third side of the triangle. Such a triangular construction substantially increases the side-to-side stiffness of the working end of the tool 10 so that useful work can be accomplished through a sweep motion.

A second embodiment of the present invention is depicted as 10*a* in FIG. 5. This embodiment is similar to that shown in FIGS. 1–4 with the principal exception that plate 18 is replaced by a plate 34 whose orientation has been changed so as to face in a direction perpendicular to the direction of handle 12. This principal difference is accompanied by a few secondary differences. Plate 34 includes a curved lower edge which may advantageously be used for attacking, chipping, scraping and otherwise loosening compacted ice and snow. Strips 16*a* are alternately fastened on opposite sides of plate 34 at their ends 20*a* by rivets 22*a* or other suitable means.

Additional strips 36 may desireably be fastened between plate 14 and plate 34 in order to increase the flexural strength of the working end of the tool without producing an undue stiffness. Strips 36 are preferably positioned at the opposite lateral sides of the tool so that the sides have greater resistance to the material being shifted than the center of the tool. In this manner, the sides of the tool may advantageously be used for moving snow out of corners and away from vertical surfaces such as the riser of a stairway.

While the above description of the invention has been made with reference to the title "Snow Removal Tool", it is not intended that this patent be limited to a hand tool exclusively used for the removal of snow. Thus, the above described hand tool may find equal application as a tool for manually shifting flake or granular material such as grain or fine gravel. Furthermore, it will be understood by those skilled in the art that the materials of construction of the above described hand tool may consist of any suitable and desirable substance such as metal and/or plastic, and that any other suitable means, such as welding, may be used to fasten the parts together. Regardless of the material of construction, the end result is a lightweight somewhat resilient instrument which may effectively be used to shift granular substances without running the danger of overexertion.

I claim:

1. A hand tool for manually shifting flake or granular material comprising:

a. a longitudinally extending handle;

b. a laterally extending base member fixed to one end of said handle;

c. a laterally extending plate member oriented to face in the direction of said longitudinally extending handle; and d. a plurality of resiliently deflectable, laterally spaced, longitudinally extending flat-sided strips oriented to face in a direction generally normal to both said handle and said base member and attached to said base member at their first ends and to said plate member at their extreme second ends so as to extend away from the end of but generally parallel to the length of said handle, a first multiplicity of said strips lying in a first plane and a second multiplicity of said strips lying in a second plane, said first and second planes intersecting said plate in first a second laterally spaced paralleled lines respectively, whereby said flat side of said strips provided partial obstruction to the flow of said flake or granular material from one side of said tool to the other when said tool is moved in a sweeping motion in the direction in which said flat sides face.

2. The hand tool as recited in claim 1 wherein said first and second planes intersect one another at a line proximate to said laterally extending base member, thereby forming a triangular construction with said first multiplicity of strips on a first side, said second multiplicity of strips on a second side and said plate on a third side, said construction providing side-to-side stiffness to the working end of said hand tool.

3. The hand tool as recited in claim 2 wherein the strips of said first multiplicity of strips alternate with the strips of said second multiplicity of strips.

4. A hand tool for manually shifting flake or granular material comprising:

a. a longitudinally extending handle;

b. a laterally extending base member fixed to one end of said handle;

c. a laterally extending plate member curved to form a cylindrical section whose concave surface faces toward said handle; and d. a plurality of laterally spaced, longitudinally extending support members having flat sides oriented to face in a direction generally normal to both said handle and said base member and attached to said base member at their first ends and to said plate member at their second extreme ends so as to extend away from the end of but generally parallel to the length of said handle, whereby said flat sides of said support members provide partial obstruction to the flow of said flake or granular material from one side of said tool to the other when said tool is moved in a sweeping motion in the direction in which said flat side face.

5. A hand tool for manually shifting flake a granular material comprising:

a. a longitudinally extending handle;

b. a laterally extending base member fixed to one end of said handle;

c. a laterally extending plate member oriented to face in a direction perpendicular to both said longitudinally extending handle and said laterally extending base member, the edge of said plate member pointing away from said handle forming a convex curve; and d. a plurality of resiliently deflectable, laterally spaced, longitudinally extending flat sided strips oriented to face in a direction generally normal to both the handle and said base member and attached to said base member at their first ends and to said plate member at their extreme second ends so as to extend away from the end of but generally parallel to the length of said handle, whereby said flat sides of said strips provide partial obstruction to the flow of said flake or granular material from one side of said tool to the other when said tool is moved in a sweeping motion in the direction in which said flat sides face.

6. The hand tool as recited in claim 5 wherein said hand tool includes reinforcing members disposed between said base and said plate member at the lateral sides thereof.

* * * * *

UNITED STATES PATENT AND TRADEMARK OFFICE

CERTIFICATE OF CORRECTION

PATENT NO. : 4,173,835

DATED : November 13, 1979

INVENTOR(S) : Dean W. Burrell

It is certified that error appears in the above-identified patent and that said Letters Patent are hereby corrected as shown below:

Column 1, line 16 the word "to" should be --for--

Column 2, line 7 the word "woven" should be --women--

Column 3, line 15 the word "to" should be --the--

Column 3, line 24 the word "sweep" should be --sweeping--

Column 4, line 17 the word "a" should be --and--

Column 4, line 19 the word "provided" should be --provide--

Column 4, line 55 the word "side" should be --sides--

Column 4, line 56 the word "a" should be --or--

Signed and Sealed this

*Twelfth* Day of *February 1980*

[SEAL]

*Attest:*

SIDNEY A. DIAMOND

*Attesting Officer*

*Commissioner of Patents and Trademarks*